US005406752A

United States Patent [19]

Neff

[11] Patent Number: 5,406,752

[45] Date of Patent: Apr. 18, 1995

[54] REVERSIBLE SANDER

[75] Inventor: Edward R. Neff, Defiance, Mo.

[73] Assignee: American Pneumatic Technologies, O'Fallon, Mo.

[21] Appl. No.: 120,421

[22] Filed: Sep. 13, 1993

[51] Int. Cl.[6] ..... B24B 23/00

[52] U.S. Cl. ..... 451/344; 418/266; 451/358

[58] Field of Search ..... 51/170 R, 170 PT; 408/239 R

[56] References Cited

U.S. PATENT DOCUMENTS 2,618,399 11/1952 Stratman et al. ..... 51/170 R
3,191,351 6/1965 Balz ..... 51/170 R
3,295,262 1/1967 Brown ..... 51/170 R
4,676,703 6/1987 Swanson ..... 408/239 R

*Primary Examiner*—Bruce M. Kisliuk
*Assistant Examiner*—Derris Banks
*Attorney, Agent, or Firm*—Kalish & Gilster

[57] ABSTRACT

A reversible rotary sanding power tool of the high speed, hand-held type includes a tool body, a tool head rotatably mounted on the tool body and adapted for replaceably retaining an abrasive disk, and a reversible, high-speed motor within the tool body and to which the tool head is rotatably coupled so as not to become accidentally disengaged upon operation of the power tool in either of the normal or reverse modes of operation.

8 Claims, 4 Drawing Sheets

REVERSIBLE SANDER

BACKGROUND AND SUMMARY OF THE INVENTION

The present invention relates generally to rotary hand tools, and, more specifically, to a high speed automatic sander which is reversible, so as to be capable of selective rotation of the sanding head in either of the clockwise or counter-clockwise directions.

Conventional rotary power sanders such as that shown in FIGS. 5 and 6 herein have been provided only with the capability of rotating the sanding disk in one direction, clockwise, from the point of view of the user of the device. While rotary power sanders have many various applications, including numerous uses in and around the home, the present invention is particularly directed toward industrial uses where especially high speeds of rotation and long periods of use may be required.

One of the more frequent uses of high speed rotary sanders is in the automobile industry, especially in the area of automobile body repair, including surface preparation and finishing. An unfortunate drawback of the unidirectional rotation of known power sanders is particularly apparent in this field. Specifically, the raw surface of the metal and each coat of paint on an automobile, whether new or refurbished, must be sanded before application of the next coat of paint, in order to ensure proper adhesion of the outermost coat and optimal appearance of the final product. Of course, rotary sanders, by their very nature, tend to throw debris accumulated from the sanded surface off the sanding disk as a surface is worked.

The dust and debris is kicked off the wheel or disk at high velocity, and thus with a significant amount of force. Accordingly, anything which is impacted by the flying debris (which may include paint chips and metal slivers) may be scratched, gouged or otherwise marred. For example, automobile windows may be damaged by flecks of material kicked from the disk of a rotary sander being used on an adjoining piece of metal. Likewise, a person positioned within the path of the flying debris may of course be injured, either by being struck by pieces of paint or metal moving at high velocity, or by inhaling from the stream or cloud of dust produced by the sanding action.

Thus, it is desirable to be able to control the direction in which the sanding disk rotates, and thereby control the direction in which the resultant debris is thrown from the disk, relative to the position of the object being sanded and to the position of the user. Frequently, in attempting to so control the flow of dust, or similarly to control the direction of disk rotation for a specific effect on the workpiece, the power sander user is forced to assume a position which is at least uncomfortable, and perhaps even dangerous. Working for extended periods of time with the body twisted into an awkward position can result in long term physical problems, as well as increased fatigue and possible mistakes and accidents in the short run.

The capability of switching rotational direction is also of great assistance when proper access to the workpiece to obtain satisfactory results can otherwise only be obtained by forcing the worker to use his or her non-dominant hand or to otherwise work in an awkward position, with the obvious consequences of decreased efficiency, increased fatigue, and possible decrease in finished work quality.

Although reversible motors are known for use in other hand-held power tools, such as commercially available drills and screwdrivers, they have not heretofore been successfully incorporated into high-speed rotary power sanders. Rather, any attempt at using such a known motor in reversible rotary power sander would have been unsatisfactory because in the reverse mode of operation the hub of the sander would become loose, and could literally fly across the room, with obvious dangerous consequences.

Thus it is an object of the present invention to provide a rotary, high-speed, power sander which can be selectively adjusted so that the sanding disk revolves either in a clockwise or counterclockwise direction.

It is further among the objects of the present invention to provide a sander having the features mentioned which can be powered, inter alia, by known pneumatic power means.

It is also among the objects of the present invention to provide a sander having the features discussed which can be operated in a safe manner, without risk of portions of the sander becoming loose and possibly airborne during use.

Accordingly, in furtherance of the above objects, the present invention is, briefly, a reversible rotary sanding power tool of the high speed, hand-held type. The tool includes a tool body, a tool head rotatably mounted on the tool body and adapted for replaceably retaining an abrasive disk, and a reversible, high-speed motor within the tool body and to which the tool head is rotatably coupled so as not to become accidentally disengaged upon operation of the power tool in either of the normal or reverse modes of operation.

The invention is also the tool described above, wherein the reversible, high-speed motor has a rotor shaft having an end which extends forwardly from the tool body for rotatably coupling to the tool head. Furthermore, the end of the rotor shaft is externally threaded and the tool head has a hub which is correspondingly internally threaded to thereby engage the end of the rotor shaft of the high-speed reversible motor.

The invention is also, briefly, the above-described tool wherein the end of the rotor shaft is hollow and has a threaded internal side wall. The tool head has a pad holder having a counterbored opening and a cap screw having a threaded shaft which corresponds to the threaded internal side wall of the rotor shaft end to thereby connect the pad holder to the high-speed reversible motor.

Also, the tool head includes a jam nut having a rearwardly disposed angled face and which is internally threaded so as to threadably engage the external threads of the rotor shaft end. The hub of the tool head has a forwardly sloped shoulder having an angle which matches that of the angled face of the jam nut, to thereby permit tight-fitting engagement of the jam nut against the shoulder of the hub when both the hub and the jam nut are disposed in their working positions on the rotor shaft end.

Also in the invention, the hub has a continuous internal side wall which defines an opening and the pad holder has an exterior side wall which corresponds in size and shape to the opening defined by the internal side wall of the hub for interlocking engagement of the hub and the pad holder in such manner that the hub and the pad retainer cannot slip circumferentially in relation to each other when under rotational force from either of the clockwise and counter-clockwise directions.

Other objects will be in part apparent and in part pointed out hereinbelow.

BRIEF DESCRIPTION OF THE DRAWINGS

Throughout the figures like parts are indicated by like element numbers.

DESCRIPTION OF THE PREFERRED EMBODIMENT

Figure 1:
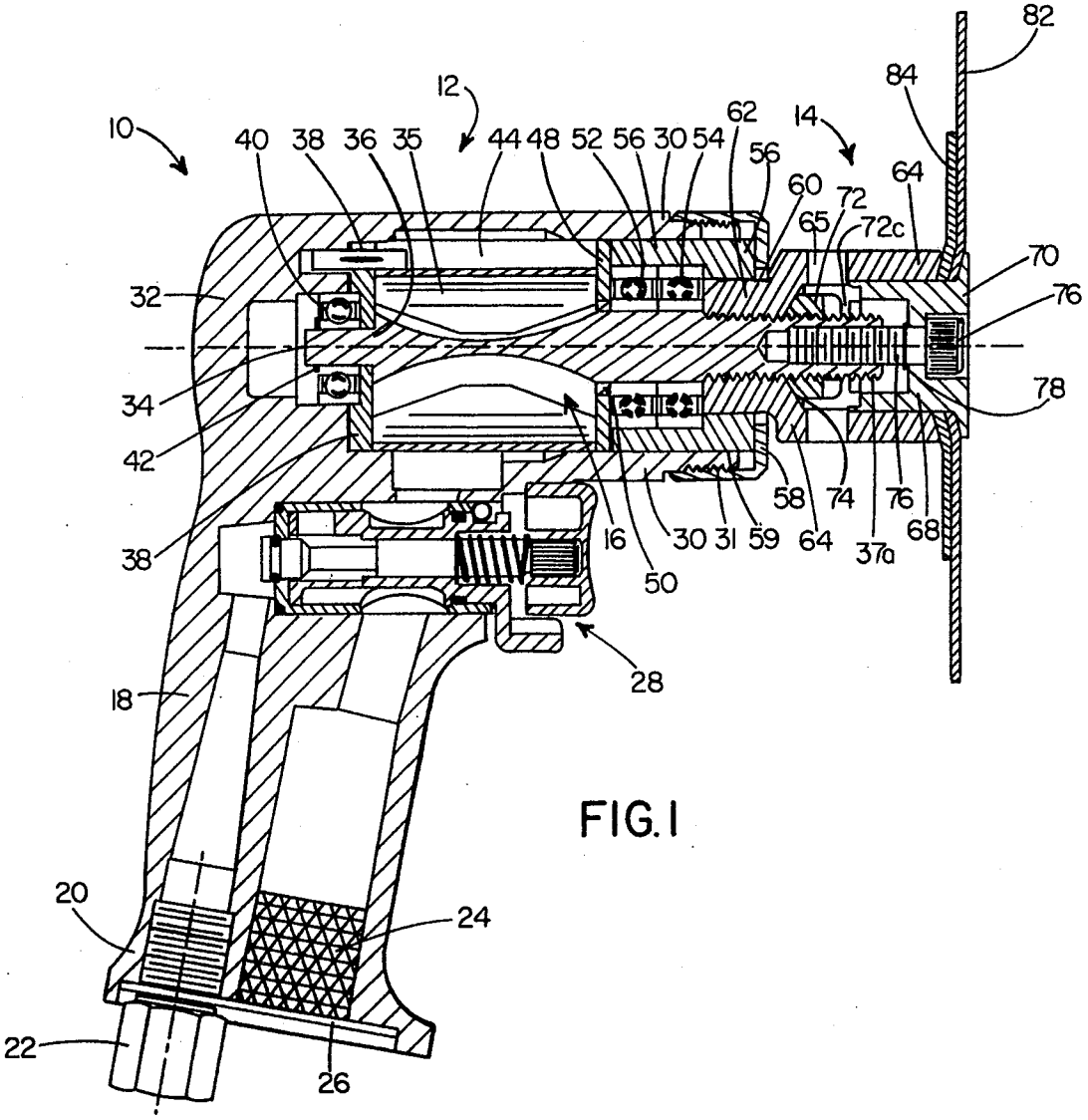
FIG. 1 is a longitudinal sectional view of a high-speed, reversible power sander constructed in accordance with and embodying the present invention.
Figure 2:
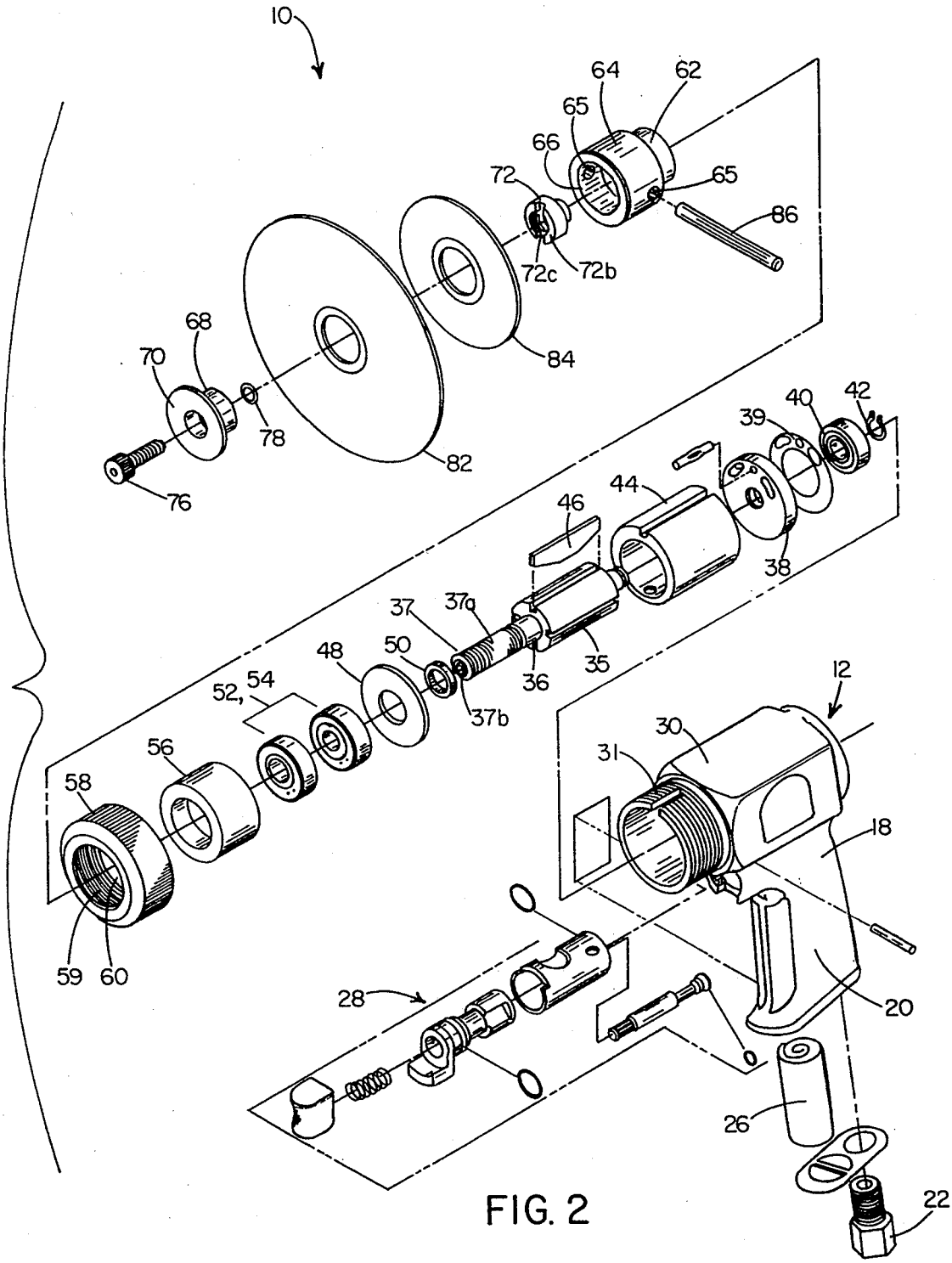
FIG. 2 is an exploded perspective view of the sander shown in FIG. 1.

With reference to the drawings, specifically in FIGS. 1–4, reference numeral 10 indicates generally a high speed reversible rotary sander constructed in accordance with and embodying the preferred form of the present invention. For clarity and completeness FIG. 2 shows sander 10 in an exploded view. However, as some portions of sander 10 are conventional, not all parts of those portions will be enumerated or described in detail.

Sander 10 is composed generally of a rigid, encasing body 12, a head portion 14 mounted forwardly on body 12, and a motor 16, which is preferably of the known high-speed reversible pneumatic type having a bidirectional ("two-way") rotor, and which will be discussed further hereafter. It is conceivable, however, that other small, high-speed reversible motors can serve adequately for the intended purpose. As will be made clear, motor 16 is uniquely coupled to head portion 14 so sanding can be safely accomplished in either a clockwise or counter-clockwise direction, as desired or required by the circumstances, including, for example the particular structure being sanded and the left or right-handedness of the sander user.

Body 12 has a well-known "pistol-grip" form with a handle 18 adapted at the normally lower end 20 thereof for receipt of a hose adapter 22 for provision of air to motor 16. Lower end 20 is also provided with a muffler 24 and exhaust deflector 26 in the usual manner.

Handle 18 extends upwardly from end 20 and receives transversely therein a poppet-type trigger mechanism 28 of known construction. As seen in FIGS. 1 and 2, trigger mechanism 28 is ordinarily positioned substantially parallel to and beneath reversible motor 16, which latter is preferably housed longitudinally within the upper or main portion of hollow body 12 and extends forwardly to front end 30 thereof, where it is engaged with head portion 14 via external threads 31, as is explained further hereafter.

The rearward end of motor 16 is positioned within the butt 32 of body 12 such that the back end 34 of rotor shaft 36 passes rearwardly and rotatably through rear motor plate 38 and is rotatably journaled within bearing 40. Bearing 40 is separated from rear motor plate 38 by a gasket 39 and maintained in its position on rotor end 34 by a retaining ring 42 in the usual manner.

Rotor shaft 36 continues forwardly through cage 44 where rotor 35 is housed and provided with a plurality of longitudinally mounted vanes 46. Rotor shaft 36 terminates forwardly in end 37 which is tubular and formed with both external and internal threads, 37*a*, 37*b*, respectively.

Rotor cage 44 is retained in position at its forward end by front motor plate 48 and rotor spacer 50, which are separated from head portion 14 by paired ball bearings 52, 54 mounted and adjacent one another on rotor shaft 36, just rearwardly of the externally threaded portion 37*a*. Bearings 52, 54 are provided in tandem in order to give improved support to the head coupling structure. Bearing retainer 56 is coaxially disposed forwardly of front motor plate 48 and outwardly of ball bearings 52, 54 on rotor shaft 36. Bearing retainer 56 includes a forward shoulder 57 which captures forwardmost bearing 54 to thereby retain bearings 52 and 54 in their longitudinal positions on shaft 36 and is itself secured by locknut 58 which connects by internal threads 59 to matching external threads 31 on forward end 30 of sander body 12, as is clearly shown in FIG. 1.

Hereafter will be described the structure of sander head portion 14 and the structure for coupling same to body 12 and motor 16 in such manner that sander 10 can be safely operated in reverse. This structure is shown enlarged, schematically, in FIGS. 3 and 4.

Head portion 14 includes a desirably heavy, metal sanding hub 64 which will spin at very high speeds during operation of sander 10 and thus must be appropriately secure in engagement to rotor shaft 36. Locknut 58, described above, has a central aperture 60 through which an internally threaded stem 62 of sander hub 64 freely passes, rearwardly, in its normal working position, threadably engaged to the corresponding external threads 37*a* of the forward rotor shaft end 37.

Forward of stem 62 hub 64 is penetrated preferably by opposed through-holes 65 (shown only in FIG. 1) for use as later explained. Although one through-hole 65 would suffice, a plurality of same eases use. Of course, an excess of such through-holes would lighten and weaken hub 64 and thus is to be avoided.

Figure 4:
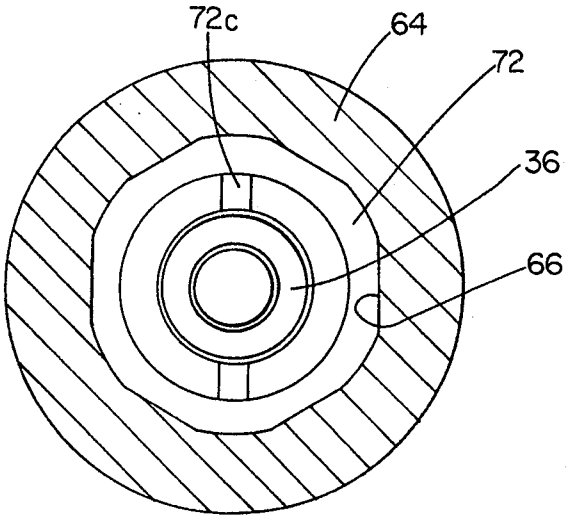
FIG. 4 is a transverse sectional view taken on line 4—4 of FIG. 3 with body hub, backing pads, sanding disk and cap screw removed.

Sander hub 64 is provided forwardly with a continuous internal side wall 66 which defines a preferably hexagonal opening, seen in FIG. 2 and enlarged schematically in FIG. 4. This hexagonal opening snugly receives a correspondingly sized hexagonally formed stem portion or body 68 of a pad retainer (or holder) 70. Of course, rather than being hexagonally shaped, as preferred, the opening defined by internal side wall 66 and the matching body 68 of pad holder 70 could be octagonal, square, splined, or otherwise keyed in their fit together so that the hub and pad holder cannot slip in circumferential relationship to one another during rotation of the sanding disk in either the clockwise or counterclockwise direction.

Serving to prevent sander hub 64 from loosening during reverse rotation is jam nut 72 which is preferably brass and threadably disposed on the forward end of rotor shaft 36. Jam nut 72 is provided with an angled face 72*a* positioned facing rearwardly on shaft 36, but forwardly of and in close-fitting, abutting relationship against a correspondingly sloped internal shoulder 74 of hub 64 on the externally threaded end portion 37*a* of rotor shaft 36.

Nut 72 also has a forwardly positioned face 72*b* with a groove 72*c* formed thereacross, which groove is normally transverse in relationship to rotor shaft 36.

Forwardly of and coaxially in relationship to jam nut 72 a socket head (cap) screw 76 is threadably engaged with the extreme forward end of rotor shaft 36. The head of screw 76 is "captive" in the counterbored outer opening 73 of pad holder 70 in the usual manner. The threaded shaft of screw 76 passes rearwardly through a retaining ring 78 disposed between the rotor shaft end and the inside surface 71 of pad holder 70 and extends to a sufficient depth to threadably engage the forwardmost end of rotor shaft 36 to which jam nut 72 has been connected.

Figure 3:
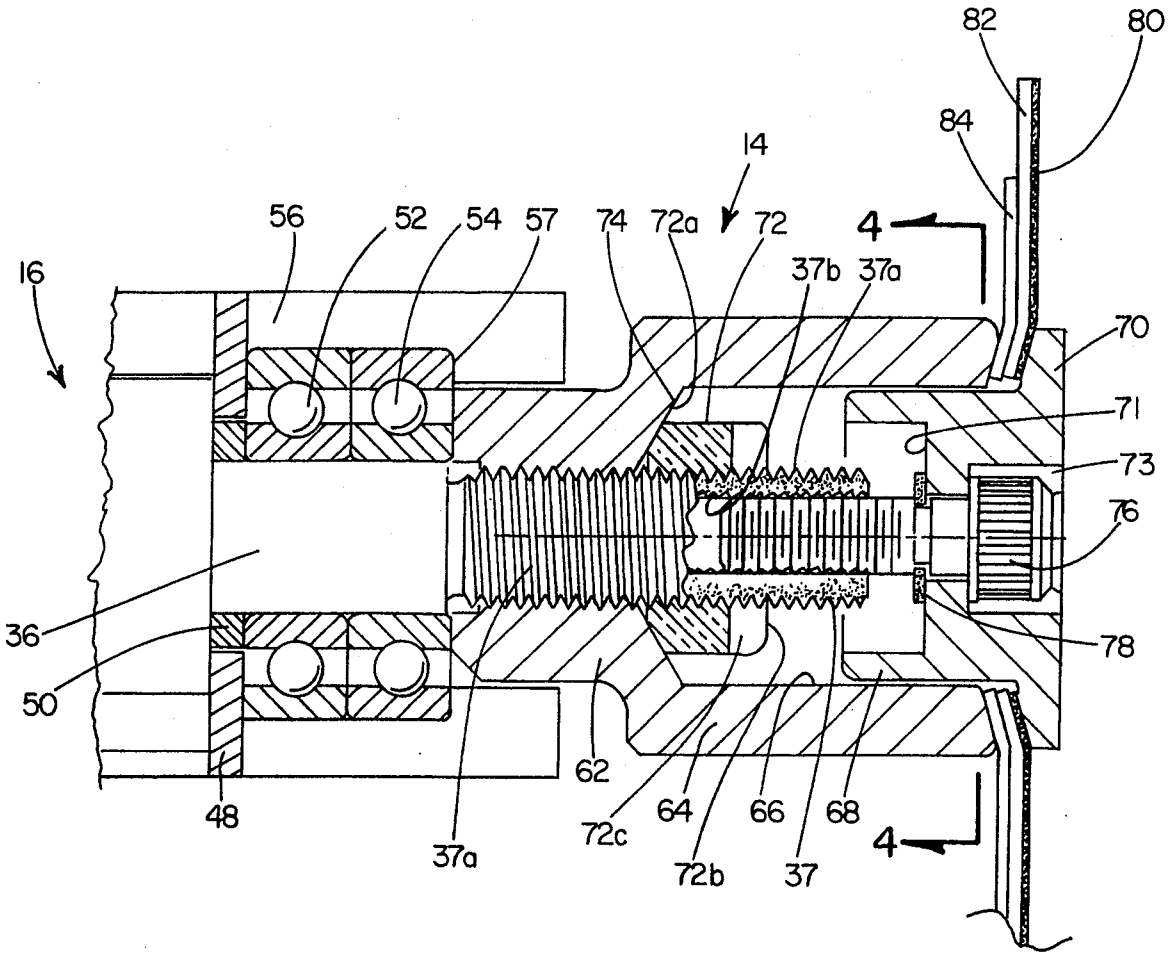
FIG. 3 is an enlarged partial sectional schematic view of the forward portion of the sander of FIG. 1.

FIG. 3 illustrates the manner in which the forward facing outer edge or flange of pad holder 70 retains an abrasive sanding disk 80 against backing pads 82, 84, and ultimately against the forward edge of sander hub 64. The sanding pad or disk 80 (not shown in FIGS. 1 and 2) and backing pads 82,84 may be of any of the presently used, commercially available types, and are replaceable as necessary due to wear or type of work to be performed.

As shown and described, in the new reversible sander 10 the sander hub 64 is threadably secured to the rotor shaft and locked in place by jam nut 72. Furthermore, the pad retainer 70 is keyed to the hub by their interlocking hexagonal shapes. Thus, no load, whether inertial or from sanding action, can cause the parts to accidentally unscrew and separate, which is especially of concern when the sander is operated at high speed in the reverse direction of head rotation.

Head portion 14 is thus safely secured on sander 10. It can only be selectively removed by persons having access to a special tool, such as for example, pin 86, which is used to simultaneously penetrate both a through-hole 65 and enter groove 72*c*, to enable rotational securement of rotor shaft 36 so that cap screw 76 can be released as desired for disassembly of head portion 14 as may be necessary, for example, to change a sanding disk.

Figure 6:
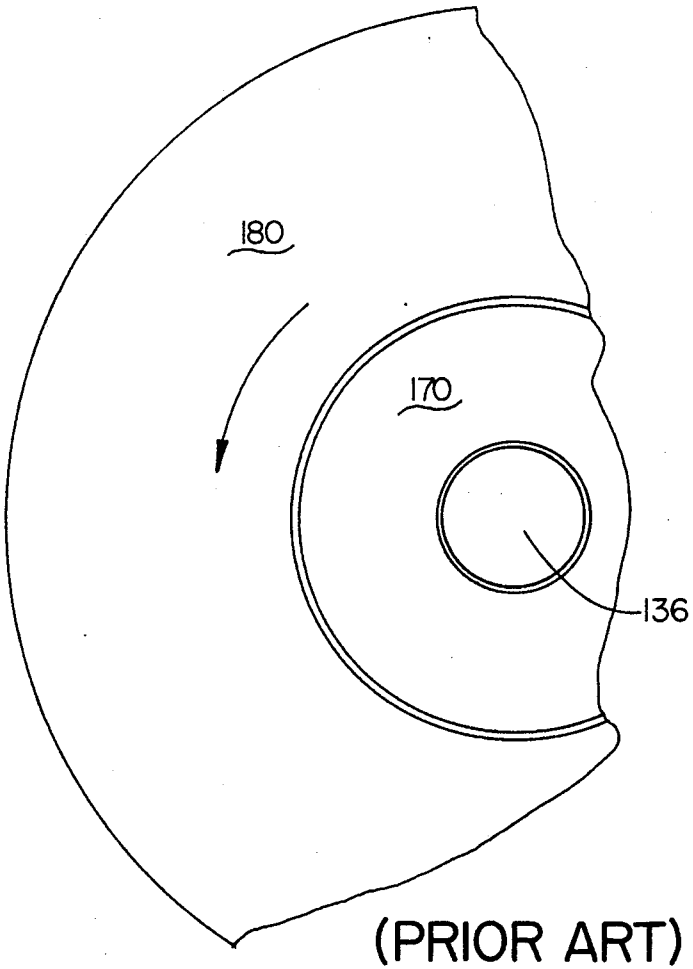
(PRIOR ART) FIG.6
FIG. 6 is a partial right end elevational view of the sander of FIG. 5.
Figure 5:
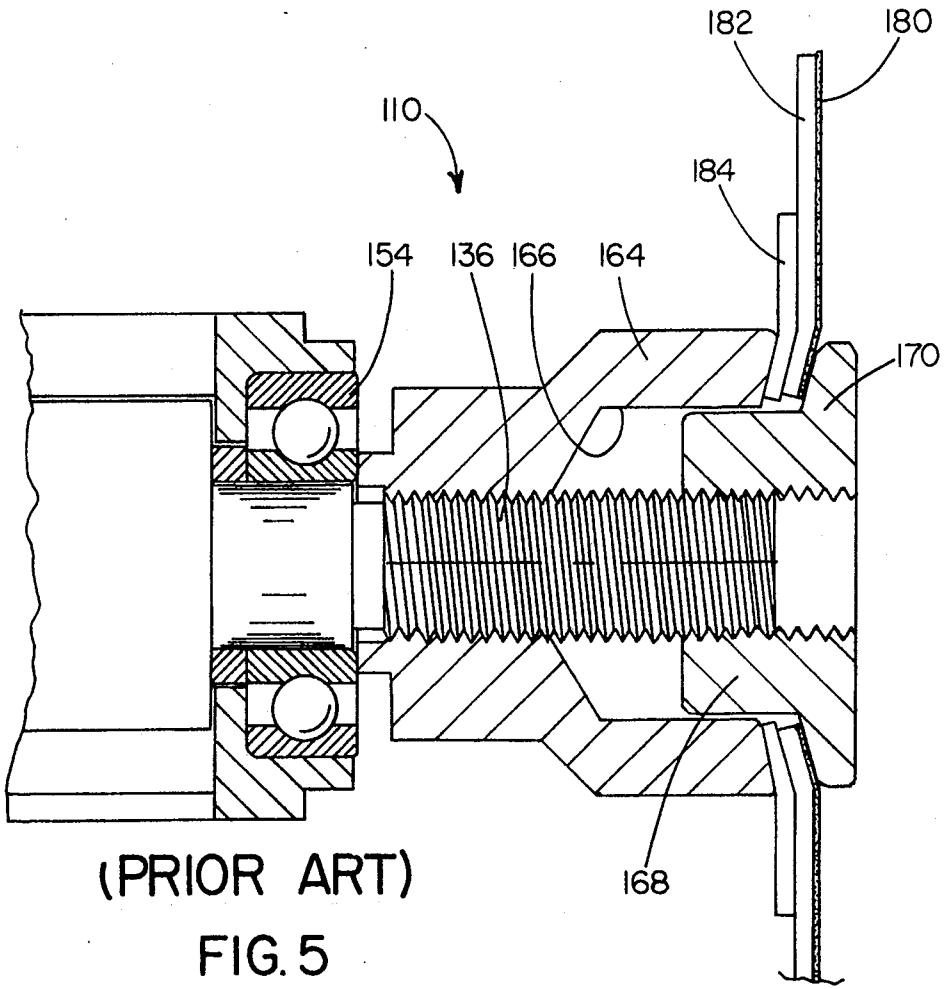
(PRIOR ART) FIG.5
FIG. 5 is a longitudinal partial sectional view of the forward portion of a previously known unidirectional sander.

The above-described structure is in stark contrast to that of the conventional, unidirectional sander 110 shown schematically in FIGS. 5 and 6. In sander 10 hub 164 is threadably engaged to the rotor shaft 137 and rearwardly abuts a single ball bearing 154. Pad holder 170 retains sanding pad 180 against backing pads 182, 184, and subsequently against the forward shoulder of hub 164. However, no jam nut and no antirotational, interlocking fit of pad holder 170 and hub 164 exists. Rather, the internal side wall 166 of hub 164 and the body 168 of pad holder 170 are round, as is customary.

Also, pad retainer 170 threads directly onto the threaded end of rotor shaft 136, forwardly of the threaded engagement of hub 164 therewith. Also, no captive screw is needed to lock the pad holder to the rotor shaft because the normal, unidirectional rotational action tends to tighten the pad holder and hub in their normal use positions.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A reversible rotary sanding power tool of the high speed, hand-held type comprising:

a. a tool body, b. a tool head rotatably mounted on the tool body and adapted for replaceably retaining an abrasive disk, and c. a reversible, high-speed motor within the tool body and to which the tool head is rotatably coupled so as not to become accidentally disengaged upon operation of the power tool in either of the normal or reverse modes of operation, wherein the reversible, high-speed motor has a rotor shaft having an end which extends forwardly from the tool body for rotatably coupling to the tool head, further wherein the end of the rotor shaft is externally threaded and the tool head has a hub which is correspondingly internally threaded to thereby engage the end of the rotor shaft of the high-speed reversible motor, and further wherein the end of the rotor shaft is hollow and has a threaded internal side wall, and the tool head has a pad holder having a counterbored opening and a screw received within the counterbored opening and having a threaded shaft which corresponds to the threaded internal side wall of the rotor shaft end to thereby connect the pad holder to the high-speed reversible motor.

2. The tool of claim 1, wherein the tool head includes a jam nut having a rearwardly disposed angled face and which is internally threaded so as to threadably engage the external threads of the rotor shaft end, and further wherein the hub of the tool head has a forwardly sloped shoulder having an angle which matches that of the angled face of the jam nut, to thereby permit tight-fitting engagement of the jam nut against the shoulder of the hub when both the hub and the jam nut are disposed in their working positions on the rotor shaft end.

3. The tool of claim 2, wherein the jam nut has a forwardly disposed face with a groove formed thereacross, and further wherein the hub is provided with at least one through-hole positioned transversely in relation to the rotor shaft to thereby provide a means by which the sander head can be removed from the sander only by penetration of the at least one through-hole and the groove by a special tool, whereby disassembly of the sander by untrained persons can be avoided.

4. The tool of claim 1, wherein the hub has a continuous internal side wall which defines an opening and the pad holder has an exterior side wall which corresponds in size and shape to the opening defined by the internal side wall of the hub for interlocking engagement of the hub and the pad holder in such manner that the hub and the pad retainer cannot slip circumferentially in relation to each other when under rotational force from either of the clockwise and counter-clockwise directions.

5. The tool of claim 4, wherein the opening defined by the interior side wall of the hub and the exterior side wall of the pad retainer are hexagonal.

6. The tool of claim 1, wherein the reversible, high-speed motor is of the pneumatic, rotary vane type.

7. The tool of claim 1, wherein the tool body is in the form of a pistol grip and includes a depending handle, a trigger mechanism disposed upwardly and forwardly on the handle and substantially transversely in relation to the longitudinal axis of the depending handle to thereby selectively activate the reversible, high-speed motor, and a butt portion adjacent the handle, the reversible, high-speed motor being mounted within the tool body portion above the trigger mechanism and adjacent and forwardly of the butt portion of the tool body in the normal use position.

8. A reversible rotary sanding power tool of the high speed, hand-held type comprising:

a. a tool body, b. a tool head rotatably mounted on the tool body and adapted for replaceably retaining an abrasive disk, and c. a reversible, high-speed motor within the tool body and to which the tool head is rotatably coupled so as not to become accidentally disengaged upon operation of the power tool in either of the normal or reverse modes of operation, the reversible, high-speed motor having a rotor shaft with an end which extends forwardly from the tool body for rotatably coupling to the tool head, the end of the rotor shaft being externally threaded and the tool head having a hub which is correspondingly internally threaded to thereby engage the end of the rotor shaft of the high-speed reversible motor, the end of the rotor shaft further being hollow and having a threaded internal side wall, and the tool head having a pad holder with a counterbored opening and a cap screw received within the counterbored opening and having a threaded shaft which corresponds to the threaded internal side wall of the rotor shaft end to thereby connect the pad holder to the high-speed reversible motor, the tool head including a jam nut having a rearwardly disposed angled face and which is internally threaded so as to threadably engage the external threads of the rotor shaft end, and the hub of the tool head having a forwardly sloped shoulder with an angle which matches that of the angled face of the jam nut, to thereby permit tight-fitting engagement of the jam nut against the shoulder of the hub when both the hub and the jam nut are disposed in their normal working positions on the rotor shaft end, the hub having a continuous internal side wall which defines a hexagonal opening and the pad holder having an exterior side wall which corresponds in size and shape to the hexagonal opening defined by the internal side wall of the hub for interlocking engagement of the hub and the pad holder in such manner that the hub and the pad retainer cannot slip circumferentially in relation to each other when under rotational force from either of the clockwise and counter-clockwise directions.

* * * * *